United States Patent [19]

Kodo

[11] 4,450,119

[45] May 22, 1984

[54] VARIABLE VENTURI CARBURETOR

[76] Inventor: Keiun Kodo, 1-9, 4-chome, Sakuragaoka, Minoo, Osaka 562, Japan

[21] Appl. No.: 428,799

[22] Filed: Sep. 30, 1982

[30] Foreign Application Priority Data

Jan. 27, 1982 [JP] Japan ..... 57-12405

[51] Int. Cl.[3] ..... F02M 9/12

[52] U.S. Cl. ..... 261/44 D; 261/53; 261/DIG. 56; 261/69 R

[58] Field of Search ..... 261/44 D, 53, 62, DIG. 56, 261/69 R

[56] References Cited

U.S. PATENT DOCUMENTS

| | | | |
|---|---|---|---|
| 1,435,947 | 11/1922 | Tracy et al. | 261/44 D |
| 1,969,638 | 8/1934 | Culp | 261/DIG. 56 |
| 1,983,255 | 12/1934 | Wahlmark | 261/44 D |
| 2,007,337 | 7/1935 | Mallory | 261/53 |
| 3,273,869 | 9/1966 | Morton | 261/50 A |
| 4,034,028 | 7/1977 | Ma | 261/DIG. 56 |
| 4,080,409 | 3/1978 | Graybill | 261/DIG. 56 |
| 4,088,715 | 5/1978 | Graybill | 261/44 D |
| 4,159,290 | 6/1979 | Honma et al. | 261/44 F |
| 4,174,361 | 11/1979 | Rollins | 261/40 |

FOREIGN PATENT DOCUMENTS

| | | | |
|---|---|---|---|
| 56-47655 | 4/1981 | Japan | 261/DIG. 56 |
| 5213 | of 1914 | United Kingdom | 261/62 |

*Primary Examiner*—Tim R. Miles

*Attorney, Agent, or Firm*—Armstrong, Nikaido, Marmelstein & Kubovcik

[57] ABSTRACT

A variable venturi carburetor has a vertically movable head which moves along the downwardly extending induction passage. The movable head includes a lower member whose vertical position is determined by an accelerator pedal for the engine on which the carburetor is adapted and an upper member defining within the induction passage an annular venturi zone and being vertically movable relative to the lower member to vary the cross sectional area of the venturi zone in response to the negative pressure developed behind the venturi zone within the induction passage. Thus, the venturi zone area is varied depending on the depression of the accelerator pedal as well as the negative pressure indicative of the ongoing engine condition such that an optimum amount of fuel is drawn therefrom to efficiently operate the engine throughout the operational range of engine RPM and load conditions. At a starting condition, more fuel is initially fed to the venturi zone through a power jet which opens in response to the introduced atmospheric pressure behind the venturi zone just before the engine starting as well as through an ever-opened main jet, whereby, in addition to more powerful suction being developed by a minimum venturi area caused by the relative movement of the upper member in response to such atmospheric pressure in the engine, produces a very rich mixture enough to start the engine without using the conventional choke valve.

2 Claims, 9 Drawing Figures

VARIABLE VENTURI CARBURETOR

BACKGROUND OF THE INVENTION

1. Fields of the Invention

This invention is directed to a variable venturi carburetor which is adapted on an internal combustion engine, more particulary to a variable venturi carburetor of the down-draught induction type which supplies a homogeneous fuel-air mixture to the engine over the wide range of changing engine conditions.

2. Description of the Prior Art

A motor vehicle is seldom operated in the restricted engine operation range, and therefore the carburetor adapted on the motor vehicle is required to constantly supply a correct fuel-air ratio depending upon the engine RPM and load conditions throughout the entire engine operational range. In prior carburetors, irrespective of whether including a fixed venturi or variable venturi, additional amounts of fuel or rich fuel-air mixture required for moving off or rapidly accelerating the vehicle will not be sucked up from a single fuel dispensing orifice, since at the time of moving off or rapid acceleration there will be sudden opening of a throttle valve or the like member which allows the additional amounts of air to inflow at such a lower velocity as to fail to draw additional amounts of fuel required for raising the engine speed. To this end, most prior devices must rely on a certain acceleration system included therein which provides an extra fuel supply to boost the normal fuel flow. However, such acceleration system has, for example, an additional fuel storage chamber or an injection pump, which is rather complicated and therefore would require frequent maintenance, adjustments and repairs. Also, these acceleration systems are controlled only by the accelerator pedal and not by the demand of the engine, such that over amounts of fuel than is needed for a particular engine operation would be produced and fed to the engine, resulting in the waste of the fuel and failing to efficiently raise the engine speed. That is, there have not been provided a carburetor of the type which is capable of compensating the over-depression of the accelerator pedal in order to supply correct amounts of fuel for acceleration purposes. Further, the prior carburetors have been provided with the choke valve for temporarily supplying a very rich mixture at the time of engine starting. The choke valve included in the carburetor adds the complexity to the latter in manufacturing and maintenance, and therefore has been desired to be removed.

SUMMARY OF THE INVENTION

The above problems associated with the prior carburetors have been solved by the present invention which includes two axially disposed upper and lower members which are moved axially within the downwardly extending induction passage. The upper member defines with a throat protruding into the induction passage a variable venturi zone therebetween whose sectional area can be increased with the lowering positions of the upper member, and it is connected to the lower member in such a way as to be capable of moving axially relative to the lower member which in turn is fixedly connected via a throttle mechanism to the accelerator pedal. The upper and lower members form therebetween a negative pressure chamber which is communicated only with the portion below the venturi zone so as to introduce the negative pressure developed behind or downstream of the venturi zone. This negative pressure or vacuum, which is indicative of the engine condition, introduced in the chamber causes the upper member to move in a direction such as to vary the cross sectional area of the venturi zone depending upon the level of such vacuum, while the lower member is maintained at the position determined by the accelerator pedal. With this arrangement, the amount of fuel drawn from a fuel dispensing orifice to the venturi portion is determined by not only the position of the accelerator pedal but also controlled by the negative pressure created by the engine, which varies depending on the engine RPM and load conditions. Accordingly, when the accelerator pedal is rapidly depressed with the engine running at a low speed, for example, as in moving off the vehicle and rapidly accelerating it from a cruising speed, it allows the considerable drop in the air velocity flowing through the induction passage as well as in the negative pressure behind the venturi zone, which will cause the upper member to ascend in such a way as to temporarily reduce the venturi zone set by the depression of the accelerator pedal, whereby the air velocity is suddenly increased to raise the suction force across the fuel dispensing orifice, such that sufficient amounts of fuel can be drawn until the engine speed come up with the position of the accelerator pedal. Immediately after the engine has increased its speed to complete the acceleration, such negative pressure increases so as to lower the position of the upper member in order to decrease the amount of fuel to a level set by the accelerator pedal, providing a correct amount of fuel depending on the engine speed attained. In this manner, the upper member defining the variable venturi zone can move automatically in response to the position of the accelerator pedal as well as the negative pressure developed behind the venturi zone in such a way as to efficiently operate the engine depending on the ongoing engine RPM and engine conditions, whereby an economical acceleration can be performed without relying upon the additional fuel storage chamber or the injection pump employed in the prior carburetor.

In addition to the above, the present invention includes fuel supply means composed of a main fuel supply passage with a main jet therein and a supplementary fuel supply passage with a power jet which operates in response to the negative pressure behind the venturi zone so as to open and therefore feed the fuel to the fuel dispensing orifice only when the negative pressure is below a predetermined level. This arrangement of the fuel supply means acts together with the above operation of the upper member to supply a very rich mixture at the starting condition by selecting appropriate vacuum levels at which the upper member and the power jet begin to operate. Before starting the engine, the atmospheric pressure present behind the venturi zone or on the engine side keeps the upper member at its highest position of forming a minimum cross sectional area of the venturi zone so as to increase the suction force for drawing the fuel at an initial starting operation, and at the same time the atmospheric pressure keeps the power jet open to feed more fuel through both fuel supply passages to the venturi zone, thus enabling to producing an additional amount of fuel or very rich mixture enough to start the engine and therefore eliminating the necessity of employing the conventional choke valve system.

Further, there is disclosed in the present invention means for adjusting the upper member at its proper position. The upper member, when out of operation, is held stationary at a position by axially oppositely biasing forces applied thereon such that its position with respect to the throat of the induction passage can be readily adjusted to produce a correct fuel-air mixture only by varying the strength of one of the two biasing forces.

Besides the features as described above, the present invention has its characteristic in that the fuel can be drawn from a single annular orifice to the annular venturi zone throughout the normal engine operation from the starting condition to the accelerating condition in order to thoroughly mix the fuel with the air to feed the homogeneous mixture to the engine, which will enhance the engine efficiency.

Accordingly, it is a primary object of the present invention to provide a variable venturi carburetor which is capable of operating in response to the negative pressure level behind the venturi zone or depending on the ongoing engine condition so as to enable the acceleration without relying on the conventional acceleration pump as well as ensure the efficient engine operation throughout the entire operational range.

Another object of the present invention is to provide a variable venturi carburetor which is capable of drawing a very rich mixture at the starting condition from a single fuel dispensing orifice, eliminating the necessity of the choke valve as employed in the prior carburetor.

A futher object of the present invention is to provide a variable venturi carburetor of simple construction which is easy to manufacture and requires a minimum in maintenance.

Still a further object of the present invention is to provide a variable venturi carburetor with ajusting means for readily adjusting the carburetor to produce a correct fuel-air mixture ratio.

A more object of the present invention is to provide a variable venturi carburetor which is capable of feeding a homegeneous mixture of fuel and air to the combustion chamber of the engine to improve the combustion efficiency.

Still further advantages and characteristics of the invention are depicted in the claims and the following detailed description, explaining preferred embodiments by way of example only.

DETAILED DESCRIPTION OF THE PREFERRED EMBODIMENTS

Figure 1:
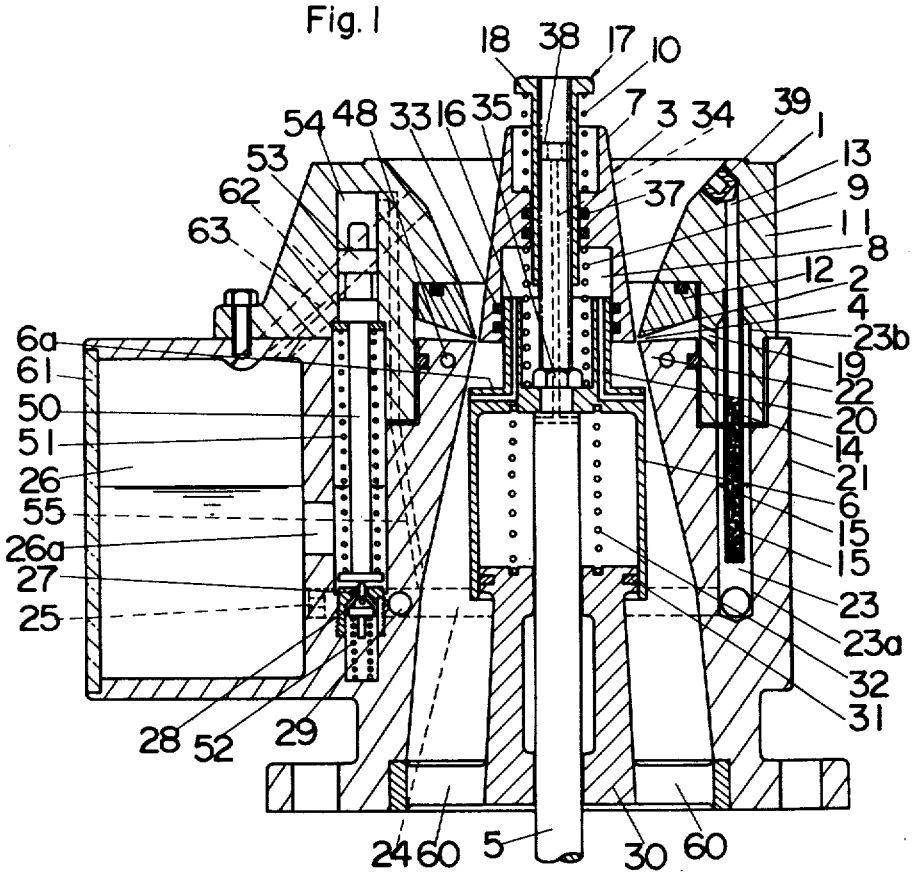
FIG. 1 is a vertical sectional view showing a variable venturi carburetor in accordance with the present invention.

Referring now to the drawings and particularly FIG. 1, there is shown a variable venturi carburetor embodying the present invention which includes a tubular housing 1 into which a downwardly flowing air stream is introduced at the upper opening thereof. The housing 1 forming a downwardly extending air induction passage of circular cross section is composed of an upper housing member 11 the upper end of which is coupled to an air cleaner (not shown) and a lower housing member 21 the lower end of which is coupled to the intake manifold 46 of an internal combustion engine. The upper housing member 11 is provided with a first throat ring member 12 removably attached to the lower portion thereof, and the lower housing member 21 is provided with a second throat member 22 formed integrally with the upper portion thereof, these throat members 12 and 22 forming a throat 2 protruding into the induction passage as well as forming an annular fuel dispensing orifice 4 therebetween. Said throat 2 has generally triangular cross section such as to form an upper beveled portion extending upwardly and outwardly from a point of minimum diameter from an upright axis as well as to form a lower beveled portion extending downwardly and outwardly from such point of minimum diameter, at which said fuel dispensing annular orifice 4 opened along the entire circumference thereof to the induction passage. The housing 1 has at its lateral side a float chamber 26 which communicates by means of fuel supply means 23 with the fuel dispensing oriffice 4. The float chamber 26 accomodates a float (not shown) and has a sight glass 61 in the side wall thereof. Within the housing 1 is coaxially disposed a vertically movable head 3 along the upright axis to form with the throat 2 a variable venturi zone whose cross sectional area is set to be minimum at the uppermost position thereof. This movable head 3 is operatively connected to an accelerator pedal for the engine on which the carburetor is adapted and is lowered by the depression of the accelerator pedal to increase the cross sectional area of the venturi zone. The movable head 3 is composed of a lower member 6 and a upper member 7 both of which are held on the upright axis or a throttle axis 5 which is connected via linkage mechanism to the accelerator pedal. The lower member 6 is of generally hollow cylinder with the upper end closed by a base 6a through which the throttle axis 5 extends and is fixedly secured by a nut 35 to the intermediate portion of the throttle axis 5, which penetrates a support 30 fixed centrally within the lower portion of the housing 1 so as to be slidably supported by the same. The lower member 6 is lowered by the depression of the accelerator pedal against the upwardly pressing force by a compression spring 32 interposed between the base 6a and the support 30 and is forced back by the spring 32 to the uppermost position when the accelerator pedal is released. In the course of the vertical movement of the lower member 6, the interior wall of the lower member 6 is kept in sealing contact by means of an O-ring 31 with the top periphery of the support 30 so as to prevent the introduction of the negative pressure created by the engine into the interior of the lower member 6, which would otherwise bring the lower member 6 out of control by the accelerator pedal. The interior of the lower member 6 communicates with the outside atmospheric pressure via a duct 34 extending through the upper portion of the throttle axis 5 to assure smooth reciprocating movement without being affected by the resistance which would otherwise arise due to the pressure variation caused within the interior of the lower member 6 with the changing vertical positions thereof. The upper portion of the throttle axis 5 extending above the base 6a of the lower member 6 is provided in the form of threaded shaft with which is threadedly engaged an adjusting tube 17 in order to be slidable along the upper portion of the throttle axis 5. Said upper member 7 is of generally conical shape with respective counterbores at its opposite ends and is coaxially held on the throttle axis 5 with its center bore receiving therein the adjusting tube 17. This upper member 7 is slidably held on the adjusting tube 17 in order to move vertically relative to the lower member 6 in response to the level of the negative pressure developed behind the throat 2 or created by the engine. The bottom counterbore of the upper member 7 receives a sleeve 16 extending upwardly and integrally from the base 6a of the lower member 6 with its side interior wall being kept in slidably contact with the exterior of the sleeve 16 in such a way as to form a negative pressure chamber 8 between the lower member 6 and the upper member 7. A seal 36 such as a labyrinth seal seals between the bottom couterbore and the sleeve 16, and the like seal 37 between the central bore and the adjusting tube 17 such that the negative pressure chamber 8 communicates only with the induction passage downstream of the throat 2 by way of an air passage 20 extending vertically through the sleeve 16 and radially through the base 6a to open at the shoulder of the lower member 6. Thus, the upper member 7 is operative to move up and down in response to the negative pressure developed behind the throat 2 or created by the engine in such a way as to move in relation to the lower member 6 irrespective of the position of the latter. Between the lower member 6 and the upper member 7 is interposed a first spring 9 applying on the upper member 6 an upwardly biasing force which is counterbalanced by a downwardly biasing force on the same by a second spring 10 interposed between the upper member 7 and the flange 18 at the top of said adjusting tube 17. Turning the adjusting tube 17 to move up or down it along the throttle axis 5 makes the strengths of these counteracting biasing forces to vary, while keeping the upper member 7 in balance so as to change the vertical position of the upper member 7 in relation to the lower member 6. In this manner, the upper member 7 can be readily adjusted to be set at a proper position substantially independently of the variations in the strength of these springs and particularly the spring 9 employed. The spring 9 has a higher spring constant than the spring 10 so that the upper member 7 is balanced at such a position well above the lower member 6 to provide a larger volume with the negative pressure chamber 8. Into the adjusting tube 17 is threadedly secured a lock member 38 which lies on the top of the throttle axis 5 for preventing the tube 17 from becoming loose.

Figure 5:
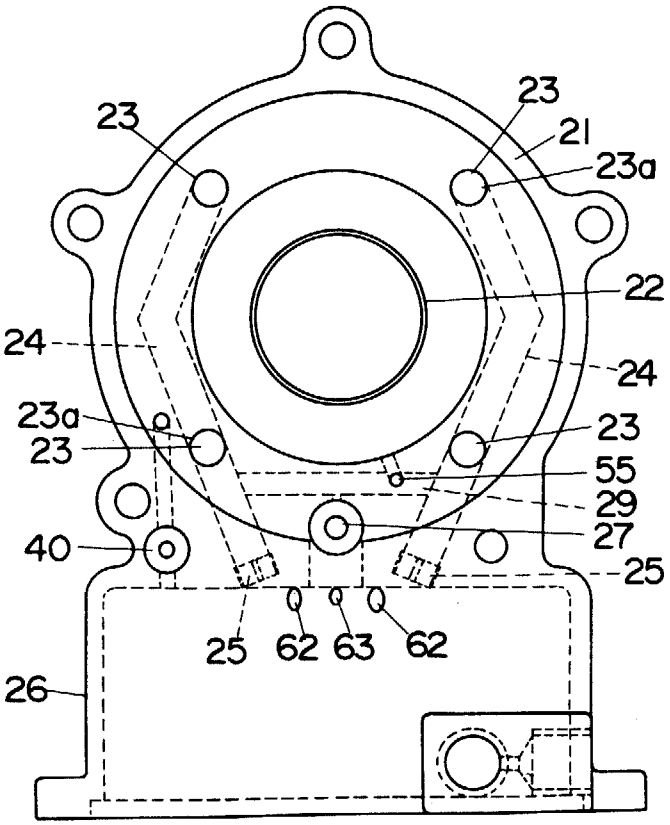
FIG. 5 is a plane view showing a lower housing of the carburetor.
Figure 7:
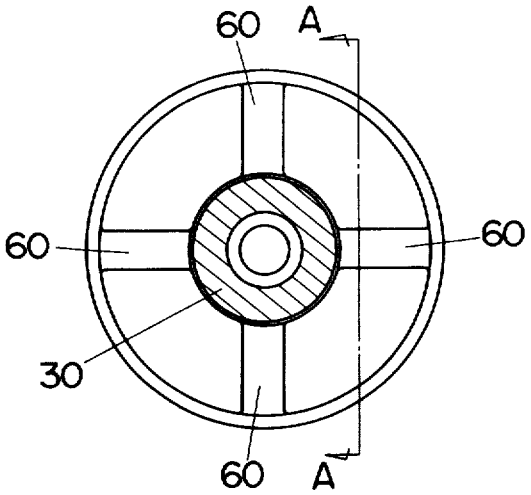
FIG. 7 is a horizontal sectional view showing a support for the movable head at lower portion of the carburetor.
Figure 8:
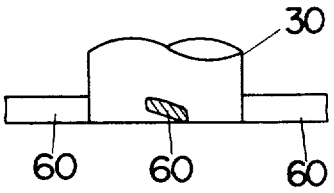
FIG. 8 is a sectional view taken along the line A—A in FIG. 7.

Fuel is supplied from the float chamber 26 to the annular orifice 4 by way of angularly spaced fuel ducts 23a extending vertically in the lower housing member 21 and aligned fuel ducts 23b extending vertically in the upper housing member 11. As shown in FIGS. 1 and 5, the fuel ducts 23a are openly connected at their respective lower ends to lateral connecting channels 24 which are opened to the lower portion of the float chamber 26 at horizontally spaced apart locations and are provided with respective main jets 25 at the positions immediately adjacent to the chamber 26. The ducts 23b are connected to ports 19 which opene into the annular orifice 4 at angularly spaced apart positions such as to constitute a main fuel supply passage leading from the float chamber 26 through the main jets 25 into the annular orifice 4. The lateral connecting channels 24 are interconnected with each other at the portions behind the main jets 25 by means of a connecting passage 29 which is in turn connected through a power jet 27 to a port 26a opened into the float chamber 26, such as to constitute a supplementary fuel supply passage leading from the float chamber 26 through the power jet 27 into the orifice 4. This power jet 27 includes a valve 28 which is pressed by a spring 52 against the valve seat to close the power jet 27 and is opened by the downward movement of a plunger 50 which is operative in reponse to the negative pressure created by the engine. The plunger 50 is biased downwardly by a spring 51 to press the valve 28 against the upward force of the spring 52 to open. At the top end of the plunger 50 is formed a piston 53 which is vertically movable within a cylinder 54 in the upper housing member 11. The cylinder 54 communicates at its lower portion below the piston 53 by way of an air vent 63 with the upper portion of the float chamber 26 which in turn communicates by way of an air vent 62 with the induction passage well above the venturi zone so as to introduce the outside atmospheric pressure within the lower portion of the cylinder 54, and it communicates at its upper portion above the piston 53 by way of an air vent 55 with the induction passage well below the venturi zone so as to introduce within the upper portion of the cylinder 54 the negative pressure developed behind the venturi zone. Such negative pressure, when rises to a certain level, will lift the piston 53 together with the plunger 50 against the downwadly biasing force of the spring 51 to close the power jet 27, drawing fuel only through the main fuel supply passage to provide a relatively smaller amount of fuel to the annular venturi zone, and will otherwise leave the piston 53 to open the power jet 27, drawing more fuel through both the main and supplementary fuel supply passage into the annular orifice.

Within each of the vertical fuel passages made of the ducts 23a and 23b in the housing 1 is centrally inserted a tube 14 extending from the upper housing member 11 to a point well below the level of the fuel introduced into the duct 23a. At the lower portion of the tube 14 are formed a plurality of vertically spaced minute holes 15 which are immersed in the fuel in the ducts 23a. The tubes 14 are aligned with respective air passage 13 extending through the upper housing member 11 to be openly connected to respective air jets 39 exposed to the upper housing interior in such a way as to draw outside air through the air jets 39 and minute holes 15 for bleeding the air into the fuel in the ducts 23a prior to the fuel being supplied to the orifice 4. The numeral 48 designates a water jacket formed within the upper housing member 11. The water jacket 48 extends about the throat 2 in close proximity to the annular orifice 4 and is adapted to receive heated water from the engine to heat the area in the vicinity of the orifice 4.

Operation of the present invention will be described hereinafter. When the engine is off, there is no negative pressure developed in the intake manifold so that the upper member 7 of the movable head 3 is held at a most remote position from the lower member 6 or uppermost position where the upwardly biasing force by the first spring 9 is balanced with the downwardly biasing force by the second spring 10. In this condition, the power jet 27 is fully opened by the plunger 50 being pressed downwardly to a full extent. At the time of starting the engine, not a so high negative pressure developed by the descend of the piston causes a suction force across the lower opening of the air passage 20 which discharges the air from the negative pressure chamber 8 as to lower the upper member 7 slightly to a position, as shown in FIG. 1, where the lowermost edge of the upper member 7 corresponds to the innermost ridge of the throat 2 such as to reduce the cross sectional area of the venturi zone to a minimum, increasing the velocity of the inflow air and thus developing a powerful suction across the orifice 4. In this condition, the power jet 27 is opened such that a relatively larger amount of fuel in relation to the volume of the passing air from the orifice 4, providing a very rich mixture required to start the engine, with the result of this, the conventional choke valve can be eliminated from the present invention.

Figure 2:
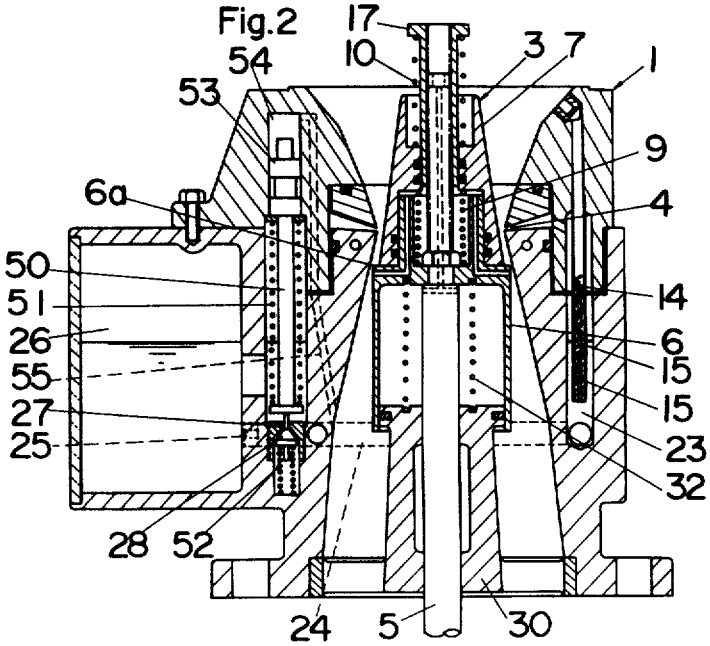
FIGS. 2 to 4 are sectional views similar to FIG. 1, showing different positions of a movable head of the carburetor at different operational conditions respectively.

When the engine is running under light loads such as with the engine idling or the vehicle travelling flat road, the depression of the accelerator pedal lowers the lower member 6 together with the upper member 7 which has been lowered against the upwardly biasing force by a high negative pressure (normaly at a pressure of −250 to −500 mmHg) developed in the intake manifold to such a relative position that its lower end comes into contact with base 6a of the lower member 6, as shown in FIG. 2. Accordingly, the upper member 7 defining the venturi zone is to move down with its lower end being in contact with the base 6a of the lower member 6 to increase the cross sectional area of the venturi zone by steady depression of the accelerator pedal, as opposed to by sudden accelerations which will described later. In this condition where the high negative pressure is developed, the power jet 27 is closed by the plunger 50 being lifted due to such negative pressure introduced through the air vent 55 into the cylinder 54, which allows the fuel to be fed only through the main fuel passages with the main jets 25 from the float chamber 26 to the annular orifice 4, while the air is bled into the fuel through the holes 15 of the tube 14 in a larger amount. Thus, steady depressing the accelerator pedal causes the upper member 7 to descend in such a way as to increase the cross sectional area of the venturi zone in a direct proportional relationship, providing an economical fuel-air mixture ratio.

Figure 3:
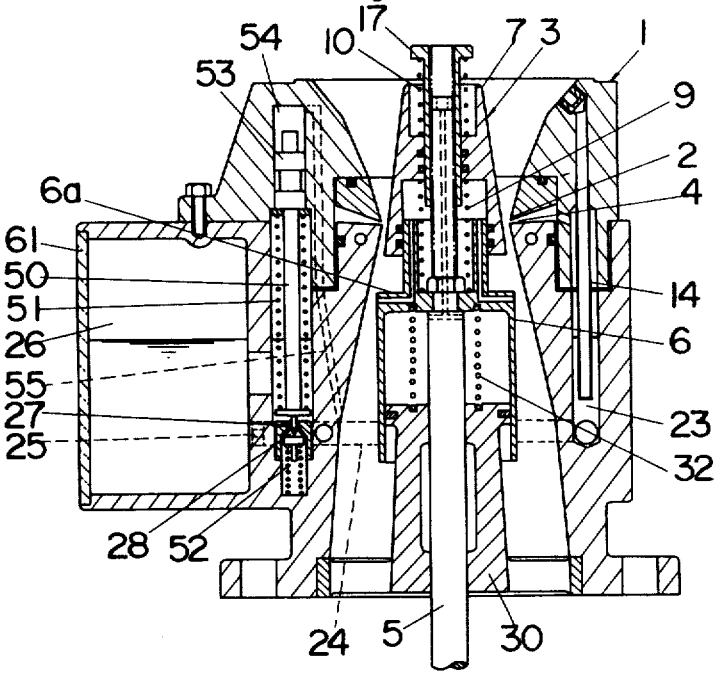
Figure 4:
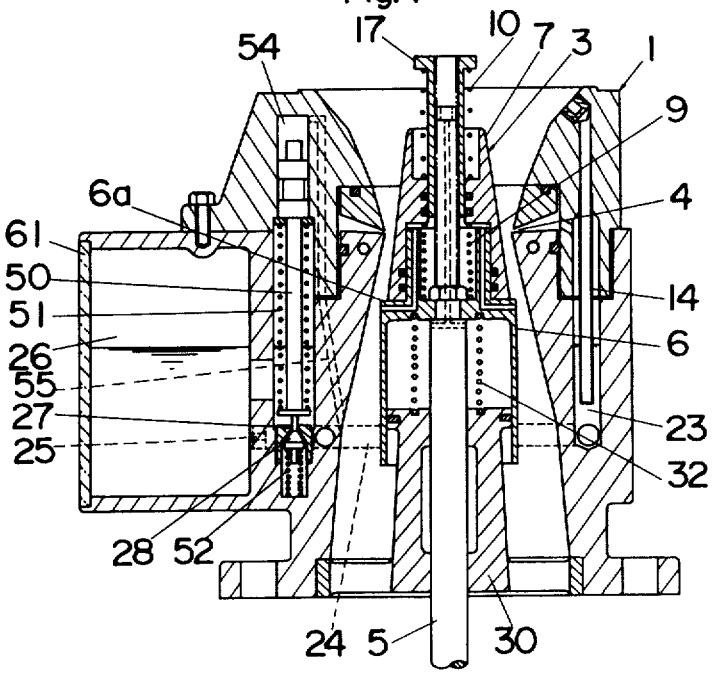

When the accelerator pedal is suddenly depressed for the engine running at such higher load conditions as required for accelerating, moving off the vehicle or travelling uphill, that is, when the engine has not been operated in an increased RPM despite of the accelerator pedal being deeply depressed, the upper member 7 is temporarily moved down together with the lower member 6 to widely open the venturi zone so as to instantaneously lower the negative pressure (to at about −100 to −200 mmHg) in the intake manifold, which causes the upper member 7 to instantaneously ascend relative to the lower member 6 by the upwardly restoring force of the spring 9 in such a way as to narrow the venturi zone while maintaining the lower member 6 at a position directly determined by the depression of the accelerator pedal as shown in FIG. 3. Thus, the air flows through the venturi zone at such an increased velocity as to develop a powerful suction across the orifice 4. The resulting lower negative pressure in the intake manifold or in the region behind the throat 2 also operates the power jet 27 to open so as to more the fuel through the supplementary fuel supply passage with the power jet 27 therein as well as through the main fuel supply passage with the main jets 25. Accordingly, more fuel is being sucked from the orifice 4 to provide a rich mixture required to raise the engine speed for effecting the above operations until the engine speed comes up with that determined by the position of the accelerator pedal, where the upper member 7 is to be lowered by the negative pressure increasingly developed in the course of raising the engine speed to such a position that its lower end comes in contact with the base 6a of the lower member 6 as to open the venturi zone to have a size directly proportional to the amount of the accelerator depression, as shown in FIG. 4, at the same time the power jet 27 is closed by such increased negative pressure. That is, the upper member 7 moves automatically relative to the lower member 6 in response to the negative pressure created by the engine and indicative of the ongoing engine condition such as to compensate a drop in feeding the fuel, such drop would arise if the venturi zone is not narrowed by the relative movement of the upper member 7.

Figure 6:
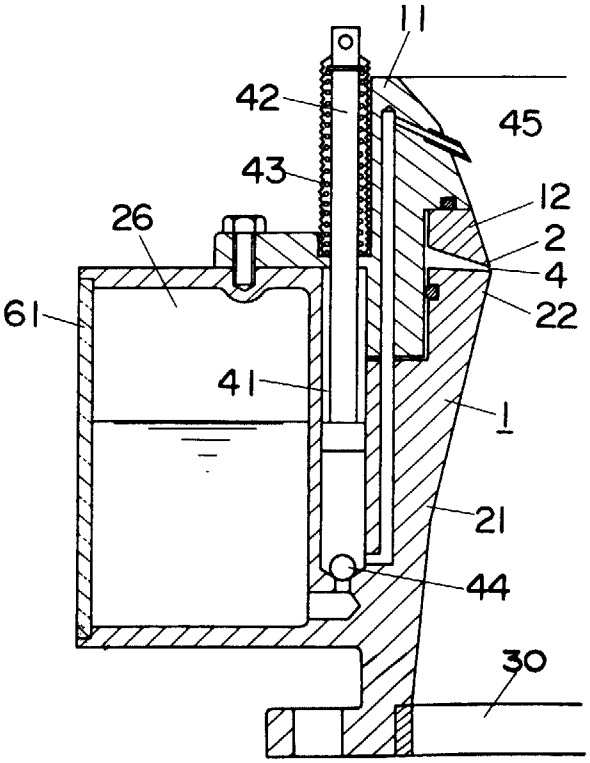
FIG. 6 is a partial sectional view showing an accelerator pump additionaly employed in the carburetor for a most rapidly accelerating purpose.

As shown in FIG. 6, the present device additionally includes an acceleration pump 40 which acts upon the accelerator pedal being depressed more rapidly to feed more additional amounts of fuel through a nozzle 45 protruding above the venturi zone for most rapid accelerating purposes. This acceleration pump 40 comprises a cylinder 41 the lower end of which is communicated with the lower portion of the float chamber 26, a plunger 42 vertically movably disposed within the cylinder 41 and biased upwardly by a spring 43, a ball valve 44 at a connecting port between the cylinder 41 and the float chamber 26, and the nozzle 45 the lower end of which is openly connected to the lower portion of the cylinder 41, whereby when the accelerator pedal is rapidly depressed, the plunger 42 is pressed downwardly by a pump linkage (not shown) to force the fuel out of the lower portion of the cylinder 41 into the upstream of the induction passage through the nozzle 45.

In addition to the above features, the fuel is drawn from the annular orifice 4 into the air flowing through the annular venturi between the upper member 7 and the throat 2 such that the fuel is mixed homogeneously with the air to supply a thoroughly mixed fuel-air mixture into the engine. This homogenization will be attained irrespective of changing air-fuel ratios throught the entire operational range to assure efficient engine efficiency. In this connection, said support 30 is held coaxially within the lower portion of the induction passage by a plurality of oblique vanes 60 arranged in equiangularly spaced relationship about the upright axis, these vanes 60 acting to swirl the inflow passing through the lower portion of the induction passage for enhancing the homogenization of the mixture to be fed into the engine cylinder.

Figure 9:
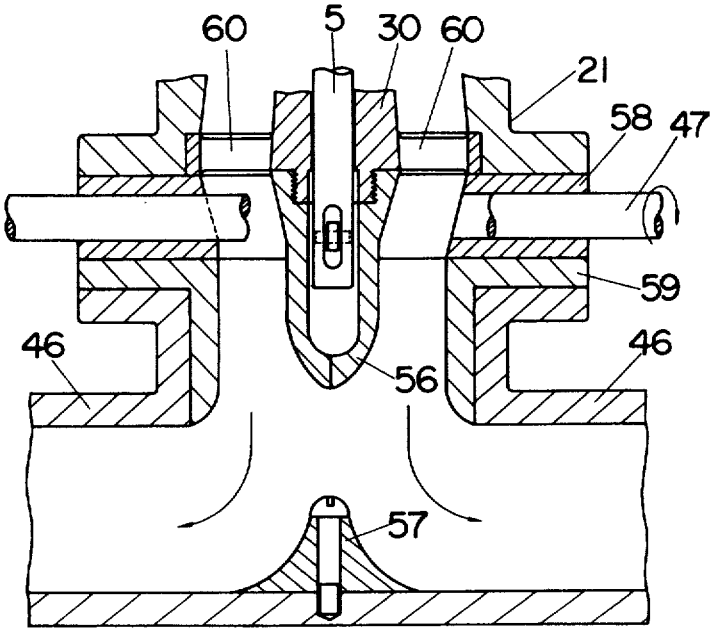
FIG. 9 is a partial vertical sectional view showing the connection between the carburetor and an intake manifold.

As shown in FIG. 9, the housing 1 is adapted to be connected to the upper opening of the intake manifold 46 by means of a base plate 58 and an adapter plate 59. Through the base plate 58 extends laterally a throttle linkage 47 which interconnects between the accelerator pedal and the throttle axis 5 by means of linkage mechanism so that the depression of the accelerator pedal causes the rotational movement of the throttle linkage 47 which in turn operates the throttle axis 5 to descend. The base plate 58 and adapter plate 59 have respectively such interior configurations as to straighten the inflow of the mixture into the intake manifold 46. Also attached to the lower end of the support 30 and to the interior wall of the intake manifold 46 at the position just below the support 30 are straighteners 56 and 57. These members 56, 57, 58 and 59 together act to prevent possible fuel adhesion to the wall of inflow channel as well as to reduce flow resistance, feeding homogeneous fuel-air mixture to the engine cylinder.

The above description and particularly the drawings are set forth for purposes of illustration only. It will be understood that many variations and modifications of the embodiments herein described will be obvious to those skilled in the art, and may be carried out without departing from the spirit and scope of the invention.

What is claimed is:

1. A variable venturi carburetor for an internal combustion engine comprising, a tubular housing having an induction passage extending downwardly therethrough;

a throat extending into said passage from the inner wall of the housing and having an annular orifice opened to the interior of the housing;

a float chamber interconnected to said orifice through fuel supply passage means for feeding fuel to the orifice;

a movable head being axially movable within the housing along an upright axis and cooperating with said throat to form therebetween an annular venturi zone whose cross sectional area is increased with lowering position of the movable head;

said movable head comprising a lower member which is adapted to be connected to an accelerator pedal for the engine so as to move downwardly in response to the depression of the accelerator pedal and a upper venturi member which is movable along the upright axis relative to the lower member and is biased upwardly, said upper member defining said venturi zone and cooperating with the lower member to provide a negative pressure chamber therebetween which communicates only with the lower region of the induction passage so as to introduce therein the negative pressure developed behind the venturi zone, whereby the upper venturi member is in response to the degree of such negative pressure pulled downwardly against the upwardly biasing force in a direction to increase the cross sectional area of said venturi zone while the lower member being maintained at the position set by the operation of the accelerator pedal; and said fuel supply passage means comprising a main fuel passage having a main jet therein and an auxiliary fuel passage having therein a power jet which is operative to open only when the negative pressure developed behind the venturi zone is above a predetermined level.

2. A variable venturi carburetor as set forth in claim 1, wherein said upper venturi member is slidably supported onto a throttle axis to which is fixedly connected said lower member and is biased upwardly by means of a first spring, the upwardly biasing force by the first spring counteracting the downwardly biasing force acting on the upper venturi member by means of a second spring which is compressedly interposed between the upper venturi member and the head of an adjusting screw, said screw being slidably threaded onto the upper end portion of the throttle axis such that its vertical movement along the throttle axis changes the strengths of the two oppositely biasing forces counterbalanced with each other so as to adjust the vertical position of the upper venturi member with respect to the throat.

* * * * *